US008714094B2

(12) United States Patent
Bober et al.

(10) Patent No.: US 8,714,094 B2
(45) Date of Patent: May 6, 2014

(54) FUEL FLUIDIZING NOZZLE ASSEMBLY

(75) Inventors: Thomas Richard Bober, Amston, CT (US); Michael Chris Tanca, Tariffville, CT (US)

(73) Assignee: ALSTOM Technology Ltd, Baden (CH)

( * ) Notice: Subject to any disclaimer, the term of this patent is extended or adjusted under 35 U.S.C. 154(b) by 988 days.

(21) Appl. No.: 12/435,632

(22) Filed: May 5, 2009

(65) Prior Publication Data

US 2010/0018444 A1 Jan. 28, 2010

Related U.S. Application Data

(60) Provisional application No. 61/083,743, filed on Jul. 25, 2008.

(51) Int. Cl.
*F23G 5/30* (2006.01)

(52) U.S. Cl.
USPC ..... 110/245; 110/243; 110/244; 261/114.2; 95/213

(58) Field of Classification Search
USPC ..... 110/243, 244, 245, 346, 348; 261/114.2; 95/213
See application file for complete search history.

(56) References Cited

U.S. PATENT DOCUMENTS

| | | | | |
|---|---|---|---|---|
| 3,421,462 | A * | 1/1969 | Wessberg | 110/238 |
| 4,865,540 | A * | 9/1989 | Fitzgerald | 431/89 |
| 5,105,559 | A * | 4/1992 | Toth | 34/585 |
| 5,425,331 | A * | 6/1995 | Abdulally | 122/4 D |
| 5,553,897 | A * | 9/1996 | Maillot | 285/192 |
| 5,966,839 | A * | 10/1999 | Pohja et al. | 34/578 |
| 6,571,746 | B1 * | 6/2003 | Kinni | 122/4 D |

FOREIGN PATENT DOCUMENTS

| | | | |
|---|---|---|---|
| EP | 0 028 458 | | 5/1981 |
| EP | 0028458 | A2 * | 5/1981 |
| EP | 2 075 360 | | 11/1981 |
| GB | 2075360 | A * | 11/1981 |

OTHER PUBLICATIONS

PCT International Search Report and the Written Opinion of the International Searching Authority dated Jan. 29, 2010—(PCT/US2009/048361).

* cited by examiner

*Primary Examiner* — Kenneth Rinehart
*Assistant Examiner* — Bao D Nguyen

(57) ABSTRACT

A grate assembly for a fluidized bed reactor includes a plurality of parallel air ducts extending side-by-side in a substantially horizontal plane and defining spaces therebetween through which coarse material from the fluidized bed descends. A plurality of nozzle assemblies is attached to each air duct for supplying fluidizing air from within the air duct into the fluidized bed. Each of the nozzle assemblies includes a nozzle formed from a tube having an inlet end in fluid communication with the air duct, and an outlet end in fluid communication with the inlet end. An orifice is disposed at the outlet end of the nozzle, and the nozzle is bent proximate the outlet end to direct a primary direction of a stream of fluidizing air flowing from the orifice toward the air duct such that an angle θ between the primary direction and the substantially horizontal plane formed by the air ducts is between about 30 to about 90 degrees.

7 Claims, 9 Drawing Sheets

FUEL FLUIDIZING NOZZLE ASSEMBLY

CROSS-REFERENCE TO RELATED APPLICATION

This application claims the benefit of U.S. Provisional Patent Application Ser. No. 61/083,743 filed Jul. 25, 2008, which is hereby incorporated by reference in its entirety.

BACKGROUND

This disclosure relates to a fuel fluidizing nozzle assembly for a fluidized bed reactor.

The use of fluidized bed reactors for the incineration of waste fuels, such as municipal refuse and high alkali fuels is generally known and involves the burning of these fuels with air while fluidizing it in a fluidized bed. The upper section of the reactor is typically equipped with a waste fuel feeding unit, and the waste fuel is burned while it is fluidized by primary air, which is blown through nozzle assemblies in a lower section of the reactor body.

The fuels are generally of low calorie content and contain a high percentage of tramp material that does not burn. As the fuels are fed to the fluidized bed, the volatile organic compounds are burned and coarse material, such as tramp material, spent bed make-up material, and ash, remain in the fluidized bed. Therefore, a fluidized bed reactor for the incineration of waste and high alkali fuels is typically equipped with a means in the lower section of the reactor body which is designed to provide fluidizing air to the fluidized bed while allowing coarse material to be removed from the reactor.

One example of a means for removing coarse material is depicted in FIG. 1, which is a top plan view of an open-floor grate assembly 10 disposed in the lower portion of a fluidized bed reactor 12. The grate assembly 10 includes a number of parallel, spaced apart air ducts 14 (also known as air pipes or bars, sparge pipes, and hydro tubes) extending side-by-side in a substantially horizontal plane. Air nozzle assemblies 16 are attached to the air ducts 14 for supplying fluidizing air from within the air ducts 14 into the fluidized bed of fuel, which is located above the grate assembly. As the organic compounds are decomposed and burned within the fluidized bed, the coarse material descends downwardly through spaces 18 between the air ducts 14. The coarse material is then discharged to external equipment and a portion of the bed make-up material may be separated from the coarse material and returned to the fluidized bed. Examples of such grate assemblies are described in U.S. Pat. No. 5,966,839 and U.S. Pat. No. 5,425,331, the contents of which are incorporated by reference herein in their entirety.

FIG. 2 depicts a cross-sectional elevation view of a portion of an air duct 14 including nozzle assemblies 16. Each nozzle assembly 16 is formed from a hollow tube 30 having an end cap 33 welded thereon and a plurality of nozzle holes 34 disposed therein proximate the end cap 33. The nozzle assemblies 16 are attached through an upper wall 32 of the air duct 14, and air from the air duct 14 passes through the hollow tube 30, and out the nozzle holes 34 into the fluidized bed of fuel. The air duct 14 may include pipes 36 through which a cooling medium, such as water, flows.

While such an arrangement works well when the nozzle assemblies 16 are newly installed, over time the nozzle holes 34, which are typically ¼ inch in diameter or less, will become plugged due to the presence of alkali materials. More specifically, alkali material gets into the nozzle assembly due to gas recirculation to the reactor and solids back flow from the bed. These alkalis cause a sticky build up on the nozzle assemblies, particularly at the nozzle holes and at any bends in the tube, which result in plugging of the nozzle assemblies. The quick plugging results in much less than the desired operating time between reactor outages for maintenance. Furthermore, repair of the nozzle assemblies typically requires cutting the top portion of the nozzle assembly, and welding a new top portion in its place, which is a time-consuming process that can extend the duration of reactor outages.

Thus, there is a need for a nozzle assembly for use in a grate assembly of a fluidized bed reactor that reduces the likelihood of plugging and, therefore, reduces the frequency of reactor outages. Furthermore, there is a need for an easily replaceable nozzle assembly to help reduce the duration of such outages.

SUMMARY

According to the aspects illustrated herein, there is provided a grate assembly for a fluidized bed reactor. The grate assembly includes a plurality of parallel air ducts extending side-by-side in a substantially horizontal plane and defining spaces therebetween through which coarse material from the fluidized bed descends. A plurality of nozzle assemblies is attached to each air duct for supplying fluidizing air from within the air duct into the fluidized bed. Each of the nozzle assemblies includes a nozzle formed from a tube having an inlet end in fluid communication with the air duct, and an outlet end in fluid communication with the inlet end. An orifice is disposed at the outlet end of the nozzle, and the nozzle is bent proximate the outlet end to direct a primary direction of a stream of fluidizing air flowing from the orifice toward the air duct such that an angle θ between the primary direction and the substantially horizontal plane formed by the air ducts is between about 30 to about 90 degrees. The nozzle assembly may further include a connector pipe disposed between the air duct and the nozzle, and a sleeve disposed around the nozzle and the connector pipe to secure the nozzle to the connector pipe. The nozzle may be welded and/or threaded to the sleeve.

In one aspect, an inside diameter of an inlet end of the orifice is chamfered to prevent a build-up of alkali material at the inlet end. In another aspect, an inside diameter of the connector pipe is equal to an inside diameter of the nozzle to prevent build-up of material at an interface between the connector pipe and the nozzle.

Each air duct may also include a plurality of capped nozzle assemblies attached thereto for supplying fluidizing air from within the air ducts into the fluidized bed. Each of the capped nozzle assemblies includes a tube having an inlet end in fluid communication with the air duct, and an outlet end in fluid communication with the inlet end. A cap is disposed at the outlet end, and a plurality of nozzle holes disposed radially through the tube at the outlet end, through which the fluidizing air passes.

In various aspects the plurality of nozzle assemblies are arranged in groups of three along the length of the air duct, each group of three including a first nozzle assembly disposed substantially at the centerline of the air duct and second and third nozzle assemblies flanking the first nozzle assembly. The primary direction of the streams of fluidizing air flowing from the orifices of the first, second, and third nozzle assemblies may be substantially parallel. Alternatively, the primary direction of the streams of fluidizing air flowing from the orifices of the second, and third nozzle assemblies are directed at an angle away from the stream of fluidizing air flowing from the orifice of the first nozzle assembly.

The above described and other features are exemplified by the following figures and detailed description.

BRIEF DESCRIPTION OF THE DRAWINGS

Referring now to the figures, which are exemplary embodiments, and wherein the like elements are numbered alike.

DETAILED DESCRIPTION

Figure 2:
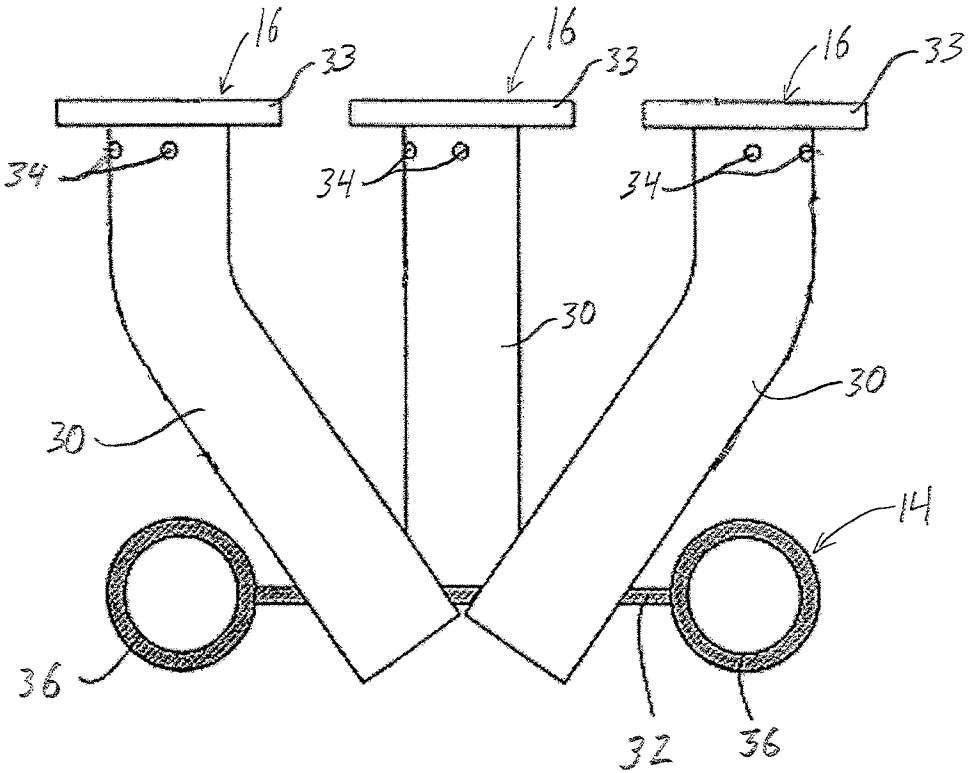
Fig. 2 (Prior Art)
FIG. 2 is a cross-sectional elevation view of a portion of an air duct of FIG. 1 including prior art nozzle assemblies.
Figure 3:
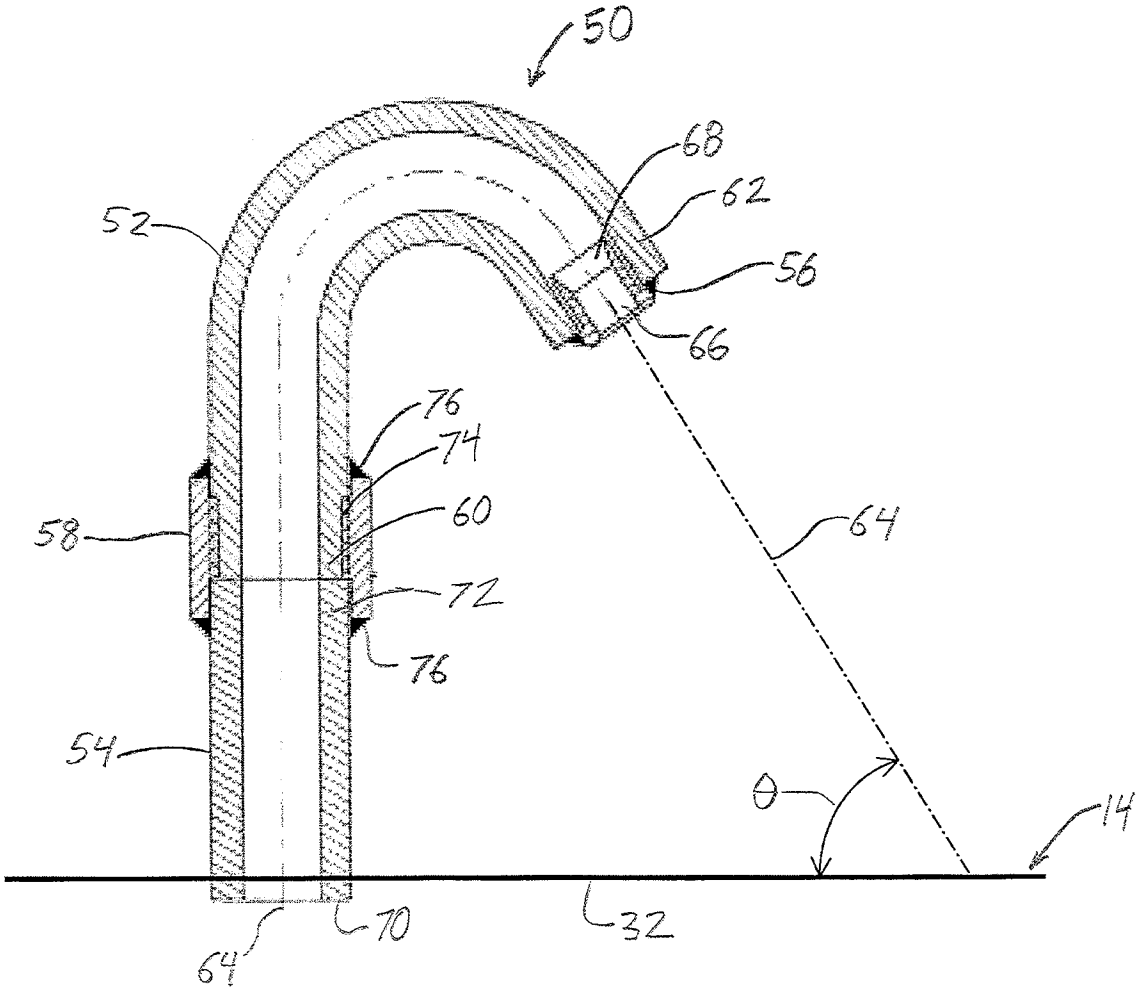
FIG. 3 is a cross-sectional elevation view of a nozzle assembly in accordance with an embodiment of the present invention.

FIG. 3 is a cross-sectional elevation view of a nozzle assembly 50 in accordance with an embodiment of the present invention. The nozzle assembly 50 includes a nozzle 52, a pipe extension 54, an orifice 56, and a connector sleeve 58. The nozzle assembly 50 is attached to the top of an air duct 14 for supplying fluidizing air from within the air duct 14 into a fluidized bed of fuel. As will be described in further detail hereinafter, the nozzle assembly 50 may be used in place of, or in addition to, the prior art nozzle assembly 16 shown in FIG. 2.

Figure 1:
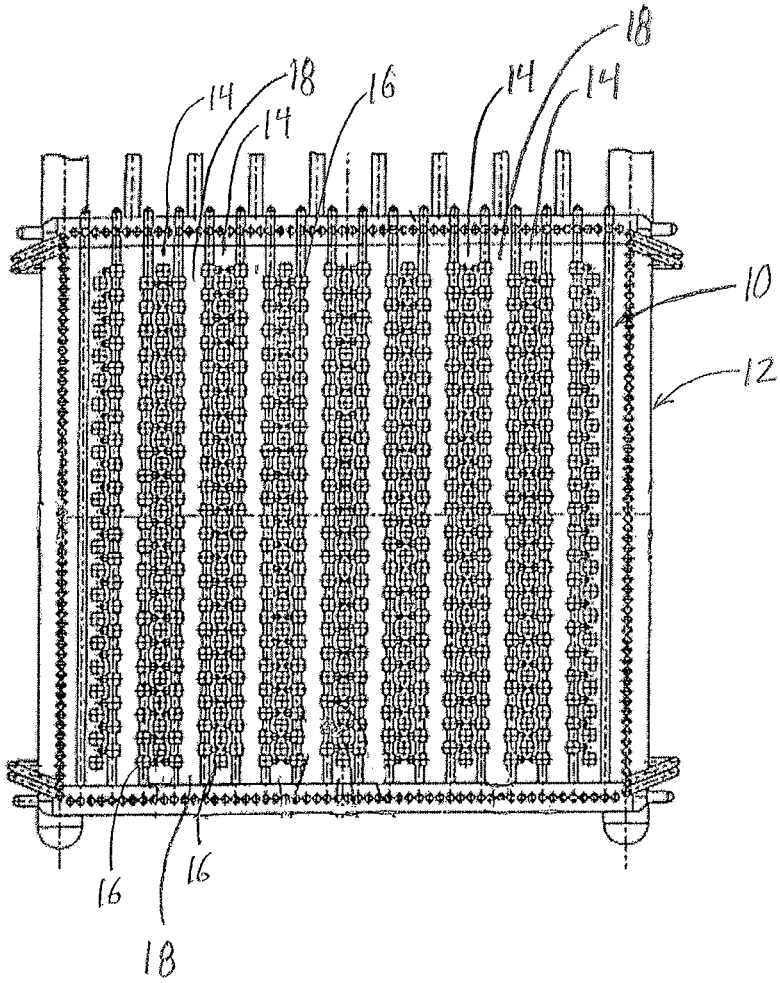
Fig. 1 (Prior Art)
FIG. 1 is a top plan view of a prior art grate assembly disposed in a fluidized bed reactor.

The nozzle 52 is formed from a tube having an inlet end 60 and an outlet end 62, and is bent proximate the outlet end 62 to form a J-shape. The nozzle 52 directs a stream of fluidizing air, which has a primary direction of flow along a longitudinal axis 64 of the nozzle 52, toward the air duct 14 at an angle θ, which is the angle between the longitudinal axis 64 of the nozzle 52 and the substantially horizontal plane formed by the top walls 32 of the air ducts 14. It has been determined that, for use with open floor grate assemblies such as those depicted in FIG. 1, the angle θ is preferably between about 30 to about 90 degrees, and more preferably between about 30 to about 50 degrees. Within this range, the stream of fluidizing air has been found to sufficiently fluidize the bed, while avoiding excessive movement of the bed and coarse materials in a horizontal direction. This is important for an open floor grate assembly, where coarse material moves downward through the floor and further mixing of the coarse material into the bed is undesirable.

To accomplish the desired angle θ, the nozzle 52 is bent to an angle between about 120 degrees to about 180 degrees, and more preferably between about 120 degrees to about 140 degrees. The nozzle 52 may be made from metal or other rigid material that is suitable for the high temperature conditions within a fluidized bed reactor.

The orifice 56 is disposed at an outlet end 62 of the nozzle 52. In the example shown, the orifice 56 is welded into the inside diameter of the outlet end 62; it is, however, contemplated that the orifice may be disposed around the outside diameter of the nozzle 52, or formed from the nozzle 52 itself. The orifice 56 preferably has a single aperture 66, which is preferably greater than or equal to ⅜ inch in diameter. Advantageously, because the nozzle assembly 50 uses a single, relatively larger aperture 66 through which air flows, the nozzle assembly 50 plugs less frequently than prior art nozzles. An inlet end 68 of the orifice 56 is chamfered (beveled) to orifice prevent build-up of alkali materials and to make the airflow into the orifice more aerodynamic.

The pipe extension 54 includes an inlet end 70, which is attached to the top 32 of the air duct 14, by welding or the like, and an outlet end 72, which abuts the inlet end 60 of the nozzle 52. The pipe extension 54 and nozzle 52 have the same inside diameter to provide a smooth interface between the two components and thus prevent any build-up of alkali material at the interface. While the pipe extension 54 is shown as being substantially straight, it is contemplated that the pipe extension 54 may include one or more bends as may be needed for a particular application. It is noted, however, that minimizing the number of bends in the pipe extension 54 is believed to help reduce the build-up of alkali materials within the nozzle assembly 50.

The sleeve 58 is disposed around the inlet end 60 of the nozzle 52 and the outlet end 72 of the pipe extension 54 to facilitate connection of the nozzle 52 and pipe extension 54. The sleeve 58 and inlet end 60 of the nozzle 52 may be secured together using a threaded interface 74. The sleeve 58 is also secured to the nozzle 52 and to the pipe extension 54 by welds 76. Preferably, tack welds are used between the sleeve 58 and the nozzle 52 so that the nozzle 52 may be quickly removed and replaced during a reactor outage. To remove or replace the nozzle 52, the tack welds 76 on the sleeve 58 are cut and then the nozzle 52 can be turned or twisted out of the sleeve 58. Advantageously, because the nozzle 52 can be quickly removed and replaced, reactor maintenance outage time can be reduced compared to that required for prior art nozzles, which require the nozzle to be cut free.

Figure 4:
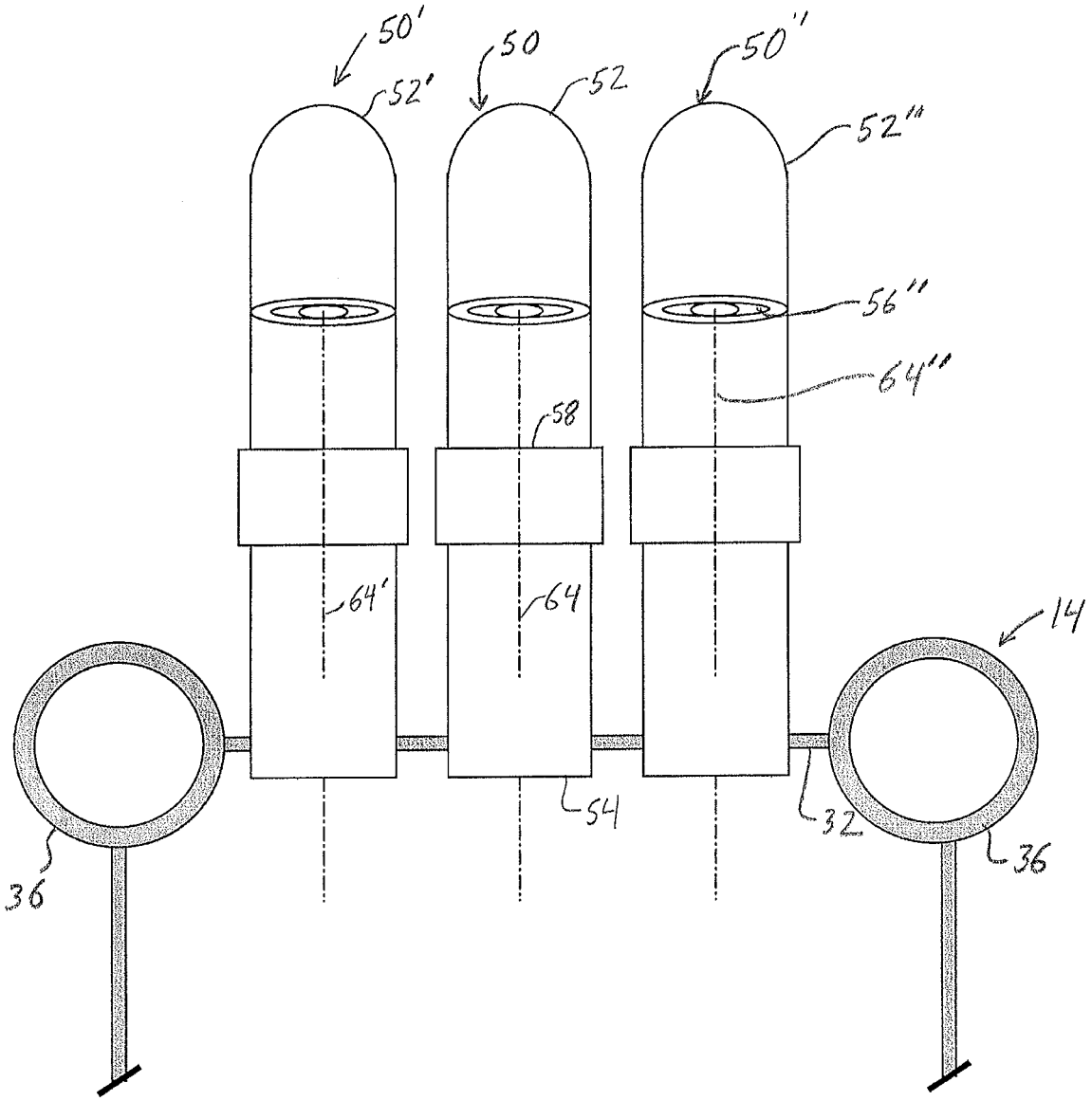
FIG. 4 is a cross-sectional elevation view of an air duct of a grate assembly including a group of nozzle assemblies of FIG. 3 in a first arrangement, as taken along section 4-4 of FIG. 5.
Figure 5:
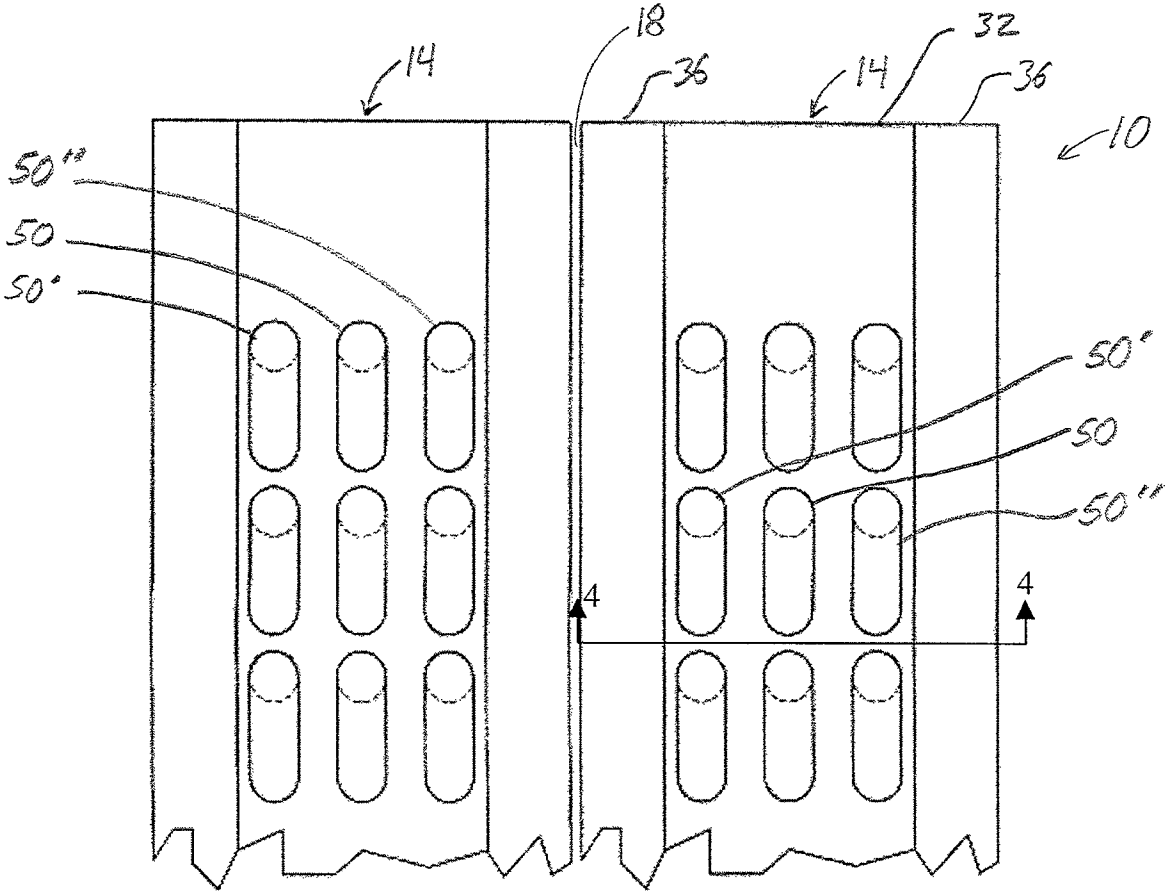
FIG. 5 is a top plan view of the group of nozzle assemblies in FIG. 4.

In designing an open-floor grate assembly, nozzle assemblies 50 are laid out in a pattern to fluidize the bed and insure that they do not have the exit of airflow pointed from one nozzle assembly 50 directly at another nozzle assembly 50. For example, FIG. 4 is a cross-sectional elevation view of an air duct 14 of a grate assembly 10 including a group of nozzle assemblies 50 (indicated as 50, 50', and 50" in a first arrangement; and FIG. 5 is a top plan view of the group of nozzle assemblies 50 in FIG. 4. Each air duct 14 includes a plurality of nozzle assemblies 50 arranged in groups of three along the length of the air duct 14. Each group of three includes a first nozzle assembly 50 disposed substantially at the centerline of the air duct 14 and second and third nozzles 50' and 50" flanking the first nozzle 50. While the three nozzle assemblies 50, 50', and 50" are shown as being aligned side-by-side, it is contemplated that one or more of the nozzle assemblies in the group may be offset from the other nozzle assemblies in the group. For example, the center nozzle assembly 50 may be offset from the flanking nozzle assemblies 50' and 50".

Figure 6:
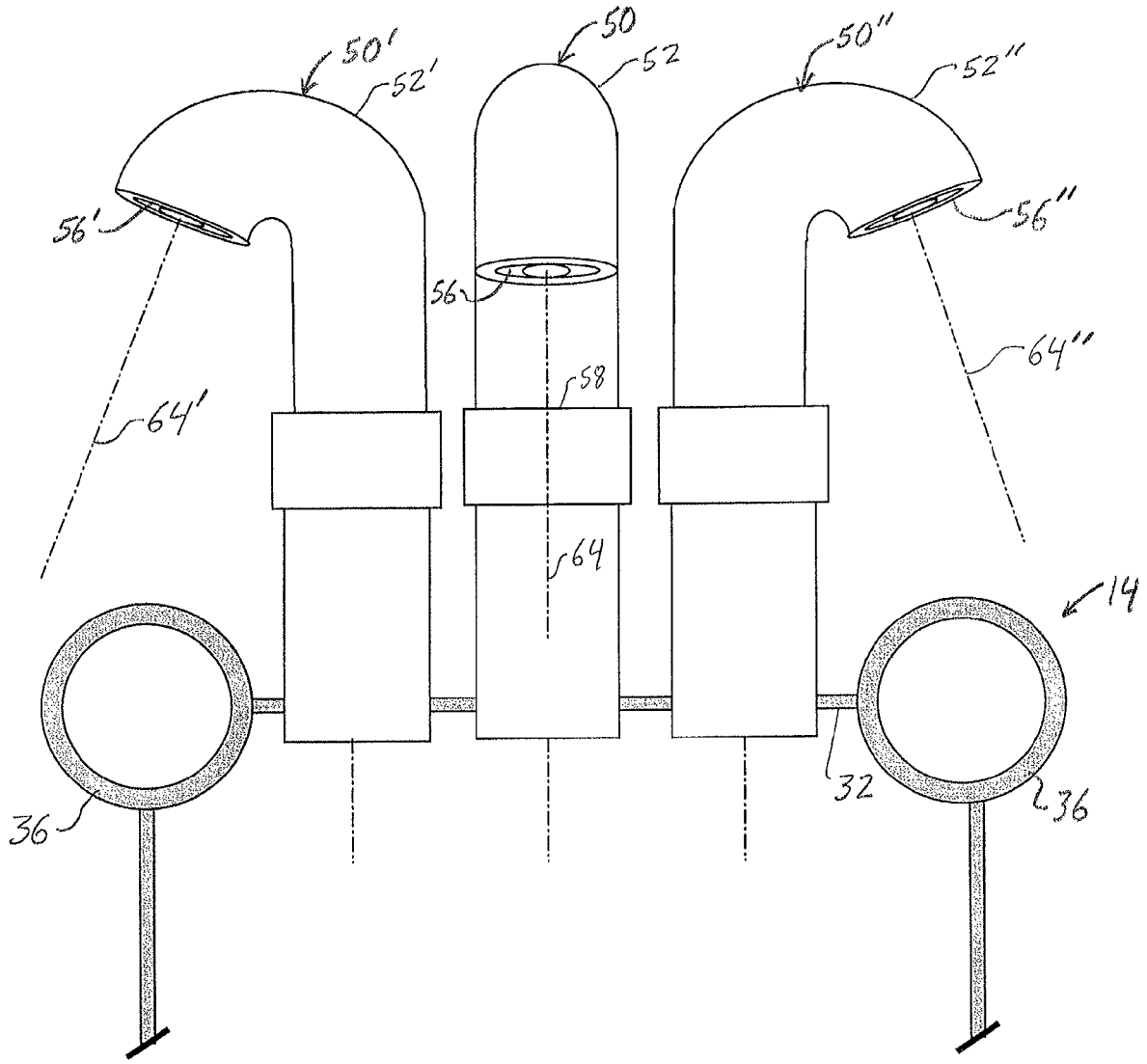
FIG. 6 is a cross-sectional elevation view of an air duct of a grate assembly including a group of nozzle assemblies of FIG. 3 in a second arrangement, as taken along section 6-6 of FIG. 7.
Figure 7:
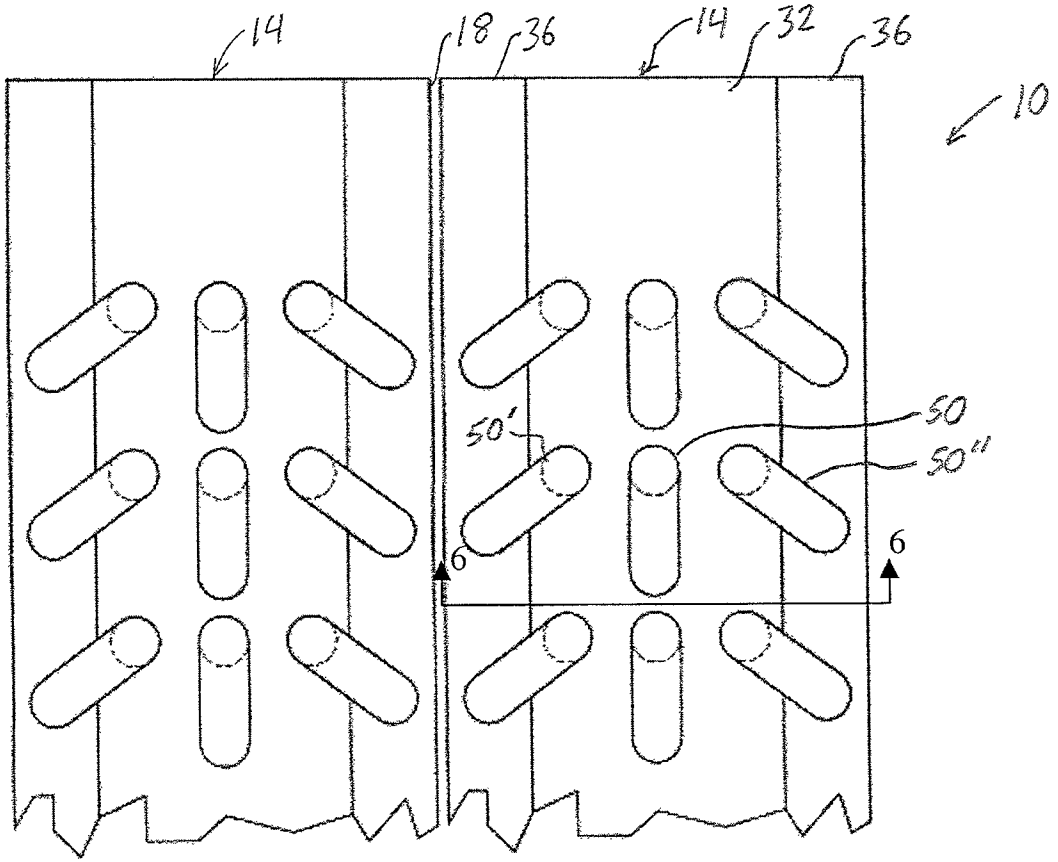
FIG. 7 is a top plan view of the group of nozzle assemblies in FIG. 6.

As shown in FIGS. 4 and 5, the longitudinal axes 64, 64' and 64" of the nozzles 52, 52' and 52" may be parallel to each other. As a result, the primary directions of the streams of fluidizing air flowing from the orifices 56, 56' and 56" are substantially parallel. Alternatively, the longitudinal axes 64, 64' and 64" of the nozzles 52, 52' and 52" may be arranged at an angle to each other, as shown in FIGS. 6 and 7. In the example shown, the center nozzle 52 is aligned with the centerline of the air duct 14, while the outer nozzles 52' and 52" are directed toward the sides of the air duct 14. As a result, the primary direction of the streams of fluidizing air flowing from the orifices 56' and 56" of the outer nozzle assemblies 50' and 50" are directed at an angle away from the stream of fluidizing air flowing from the orifice 56 of the center nozzle assembly 50. With this arrangement, the air streams provided by the outer nozzle assemblies 50' and 50" help direct coarse material downward into the spaces 18 between the air ducts 14. Advantageously, the direction of the air stream from a nozzle assembly 50 can be changed simply by rotating the nozzle 52 within the sleeve 58.

Figure 8:
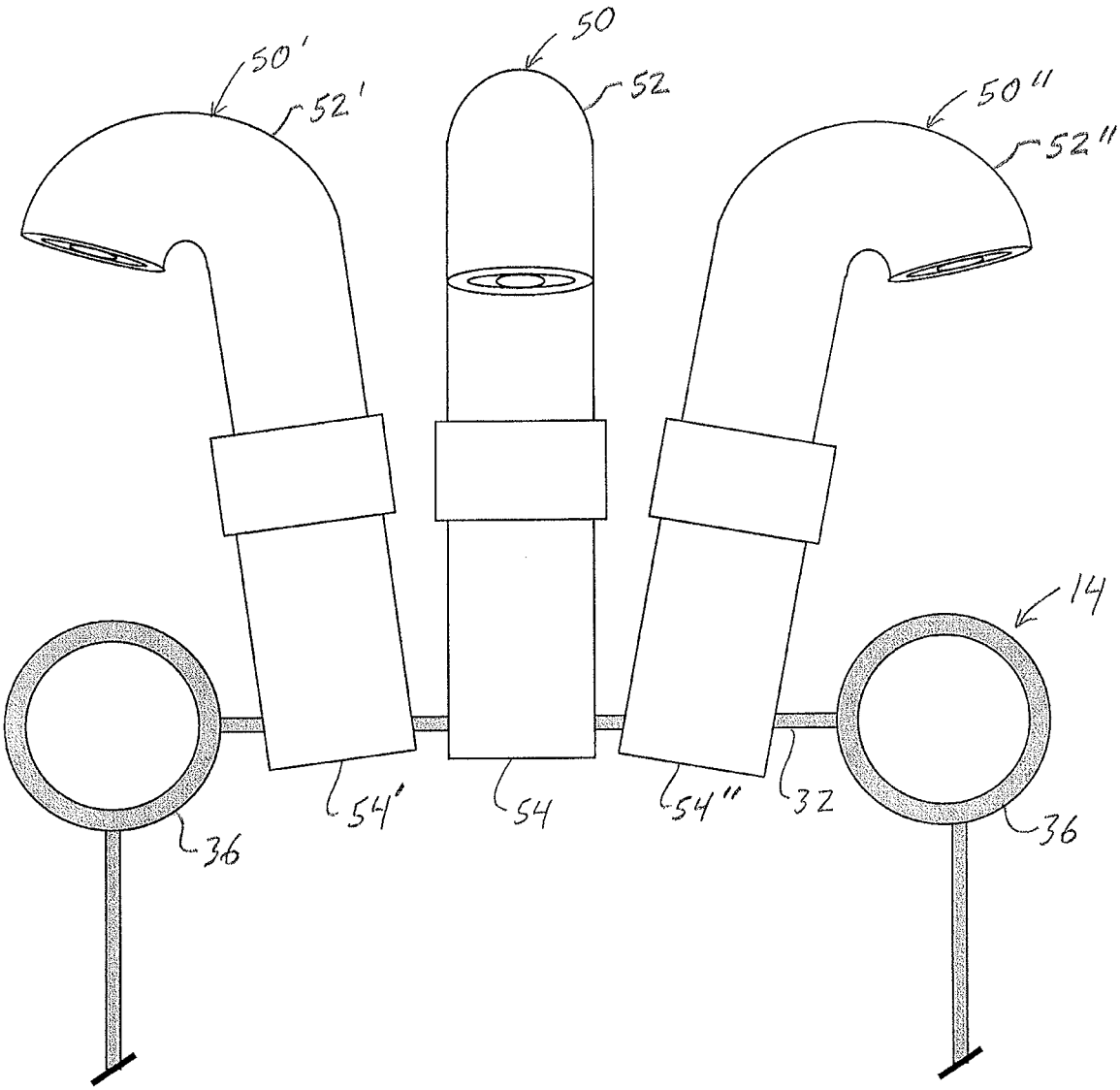
FIG. 8 is a cross-sectional elevation view of an air duct of a grate assembly including a group of nozzle assemblies of FIG. 3 in a third arrangement.
Figure 9:
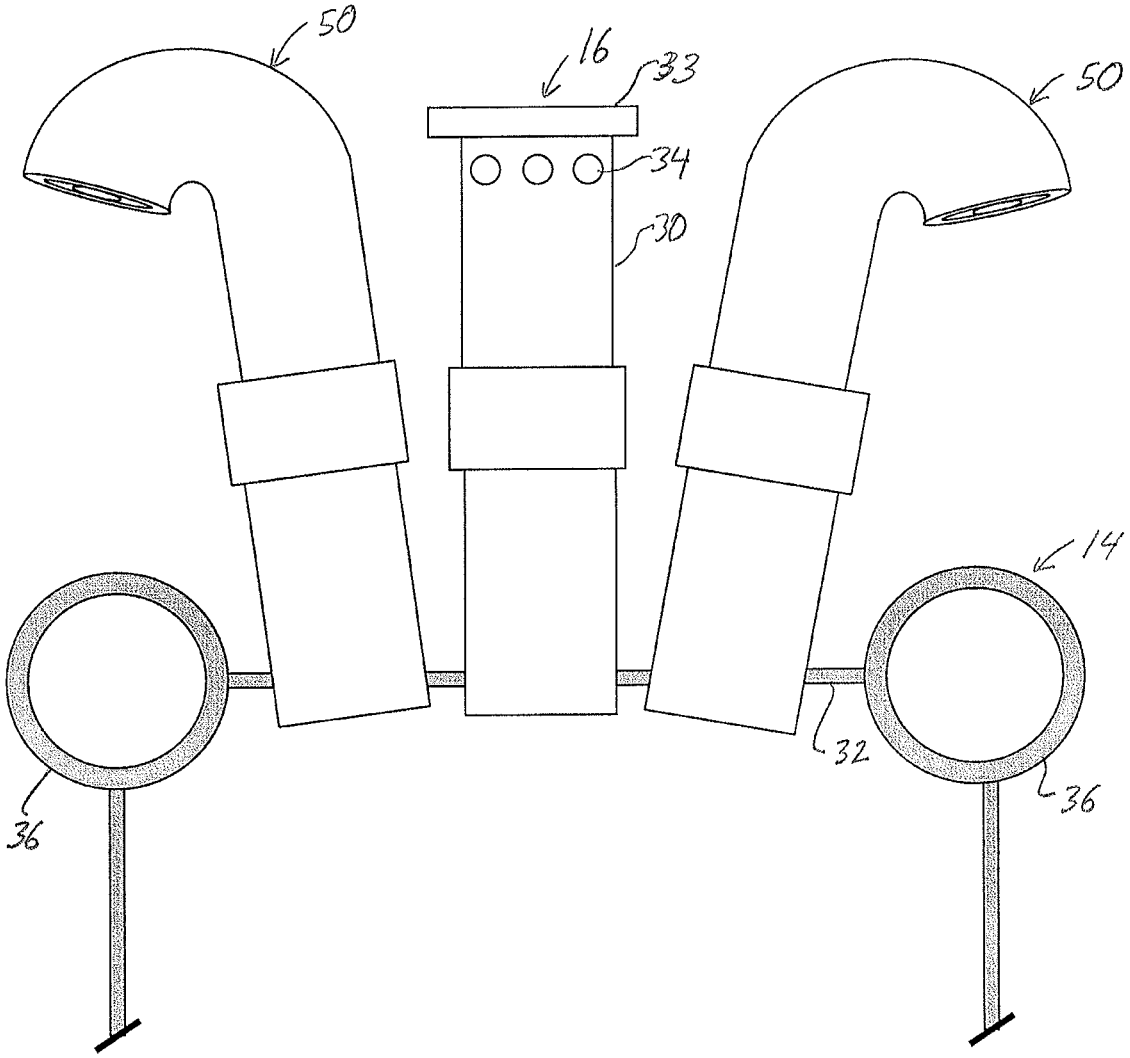
FIG. 9 is a cross-sectional elevation view of an air duct of a grate assembly including nozzle assemblies of FIG. 3 and FIG. 2.

As shown in FIG. 8, one or more of the pipe extensions 50 may be angled to adjust the position of the air stream provided by the nozzles 52. In the example shown, the pipe extensions 54' and 54" of the outer nozzle assemblies 50' and 50" are angled outward from the center nozzle assembly 50. Furthermore, as shown in FIG. 9, one or more nozzle assemblies 50 may be used in conjunction with a prior art nozzle assembly 16. As previously noted, such prior art nozzle assemblies 16 are typically formed from a hollow tube 30 having an end cap 33 welded thereon and a plurality of nozzle holes 34 disposed therein proximate the end cap 33.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A grate assembly for a fluidized bed reactor, the grate assembly comprising:

a plurality of parallel air ducts extending side-by-side in a substantially horizontal plane and defining spaces therebetween through which coarse material from the fluidized bed descends;

a plurality of nozzle assemblies attached to each air duct for supplying fluidizing air from within the air duct into the fluidized bed, each of the assemblies including:

a nozzle formed from a tube having an inlet end in fluid communication with the air duct, and an outlet end in fluid communication with the inlet end, and a chamfered orifice disposed at the outlet end, wherein the nozzle is bent proximate the outlet end to direct a primary direction of a stream of fluidizing air flowing from the orifice toward the air duct such that an angle θ between the primary direction and the substantially horizontal plane formed by the air ducts is between about 30 to about 90 degrees, and wherein each nozzle assembly includes a connector pipe disposed between the air duct and the nozzle and a sleeve disposed around the nozzle and the connector pipe to secure the nozzle to the connector pipe, wherein the connector pipe is a separate element from the nozzle and the nozzle is tack welded to the sleeve.

2. The grate assembly of claim 1, wherein the angle θ is between about 30 to about 50 degrees.

3. The grate assembly of claim 1, wherein the nozzle is bent to an angle of between about 120 degrees to about 180 degrees.

4. The grate assembly of claim 1, wherein an inside diameter of an inlet end of the orifice chamfers the orifice to prevent a build-up of alkali material at the inlet end.

5. The grate assembly of claim 1, wherein an inside diameter of the connector pipe is equal to an inside diameter of the nozzle to prevent build-up of material at an interface between the connector pipe and the nozzle.

6. The grate assembly of claim 1, wherein the plurality of nozzle assemblies are arranged in groups of three along the length of the air duct, each group of three including a first nozzle assembly disposed substantially at the centerline of the air duct and second and third nozzle assemblies flanking the first nozzle assembly.

7. The grate assembly of claim 6, wherein the primary direction of the streams of fluidizing air flowing from the orifices of the second, and third nozzle assemblies are directed at an angle away from the stream of fluidizing air flowing from the orifice of the first nozzle assembly.

* * * * *